United States Patent [19]

Honda et al.

[11] Patent Number: 4,564,499

[45] Date of Patent: Jan. 14, 1986

[54] METHOD OF INHIBITING CORROSION OF CARBON STEEL PIPING OF CONDENSATE AND FEED WATER SYSTEMS IN POWER GENERATING PLANT

[75] Inventors: Takashi Honda, Katsuta; Akira Minato, Hitachi; Masakiyo Izumiya, Mito; Eizi Kashimura; Katsumi Ohsumi, both of Hitachi, all of Japan

[73] Assignee: Hitachi, Ltd., Tokyo, Japan

[21] Appl. No.: 666,033

[22] Filed: Oct. 29, 1984

Related U.S. Application Data

[63] Continuation of Ser. No. 347,033, Feb. 8, 1982, which is a continuation-in-part of Ser. No. 156,640, Jun. 4, 1980, abandoned.

[30] Foreign Application Priority Data

Jun. 8, 1979 [JP] Japan ..... 54-71201

[51] Int. Cl.[4] ..... G21C 9/00

[52] U.S. Cl. ..... 376/305; 422/7; 422/14

[58] Field of Search ..... 376/298, 299, 305, 306; 422/7, 14

[56] References Cited

U.S. PATENT DOCUMENTS 3,663,725 5/1972 Pearl ..... 376/306

OTHER PUBLICATIONS

Nuclear Engineering Handbook, H. Etherington, McGraw-Hill, New York, 1958, pp. 13-6 to 13-11.

*Primary Examiner*—Charles T. Jordan
*Assistant Examiner*—Richard W. Wendtland
*Attorney, Agent, or Firm*—Antonelli, Terry & Wands

[57] ABSTRACT

A method of inhibiting corrosion of carbon steel piping of condensate and feed water systems in a power generating plant, characterized by continuing the water in said piping to flow after also said plant has been shut down until it is restarted up and by keeping the specific electric conductivity of flowing water at 0.5 μS/cm or less.

19 Claims, 11 Drawing Figures

1μm

1μm

METHOD OF INHIBITING CORROSION OF CARBON STEEL PIPING OF CONDENSATE AND FEED WATER SYSTEMS IN POWER GENERATING PLANT

This application is a continuation of application Ser. No. 347,033, filed Feb. 8, 1982, which is a continuation-in-part application of application Ser. No. 156,640, filed June 4, 1980 and now abandoned.

BACKGROUND OF THE INVENTION

The present invention relates to a method of inhibiting corrosion of carbon steel piping of condensate and feed water systems in power generating plant at shutdown period thereof.

In a system in which water dissolving oxygen and carbon steels are in contact, carbon steels are corroded, and in stationary water, the higher the concentration of dissolved oxygen, the greater the degree of corrosion. Particularly, when water dissolving oxygen of about 40 to 30,000 ppm, carbon steels in contact with water are subjected to corrosion, for which inhibitive measures are required.

In boiling water reactor (BWR) plants, particularly during the shutdown period due to the periodical inspection and others, the piping of the condensate and feed water systems are exposed to water of dissolved oxygen concentrations of as high as 5 to 8 ppm under the condition open to the air, so that carbon steels for the piping are corroded. Corrosion products (mainly composed or iron oxides and called "crud") might be brought into the reactor at the plant starting time and deposited on fuel rods, thereby causing the decrease in thermal efficiency and the failure of the fuel rods. Furthermore, crud deposited on the fuel rods, after activated, is in danger of peeling off and being redeposited on components, such as the piping of a reactor recirculating system, thereby causing the increase in the surface dose rates of components such as the piping and the increase in radiation exposure doses for persons engaged in the periodical inspection.

From these reasons, corrosion inhibitive measures are regarded as an important subject with respect to the piping of the condensate and feed water systems particularly during the shutdown period of BWR plants.

A drain-drying method, as referred to "hot drain off", has been so far applied to some plants for inhibiting corrosion in a system in which water dissolving oxygen and carbon steels are in contact, particularly for the piping during the shutdown period of BWR plants. In this method, the piping are drained after the plane has been shutdown, but before feed water gets cold, thereby having their surfaces dried by remaining heat. However, such a method can not be necessarily applied to any plant because of the structural differences among plants, and also a great amount of liquid radioactive waste resulting from the drainage provides a problem in its treatment. Furthermore, this drain-drying method is not suitable in cases where the shutdown period is short because of its complicated operation.

Besides, U.S. Pat. No. 3,663,725 discloses method for inhibiting corrosion of piping in water cooled reactors by introducing into feed water a small amount of oxygen and hydrogen (about 100 to 300 ppb oxygen and a stoichiometric quantity of hydrogen).

As other method of inhibiting corrosion, in fossil fuel power plants, when a shutdown period is short, a wet layup method based on the addition of hydrazine is applied, while in the case of a long shutdown period, a dry layup method in which pipes are filled with nitrogen gas after drainage is applied. These method, however, can not be applied to inhibit corrosion in BWR plants because there are problems of post-treatment such that hydrazine must be removed before the following starting time or nitrogen gas must be deaerated.

OBJECT OF THE INVENTION

The present invention is directed to the improvement of the state of the art described above.

It is an object of the invention to provide a method of inhibiting corrosion of carbon steels in contact with water in a system in which water dissolving oxygen and carbon steels are in contact.

It is a more particular object of the invention to provide a simple method applicable to inhibiting corrosion of the piping of the condensate and feed water systems during the shutdown period of BWR plants.

SUMMARY OF THE INVENTION

Generally, corrosion of carbon steels progresses through a local cell reaction, as proved by experiments. This is briefly described by the use of a model as follows:

As shown in FIG. 1, when there are two kinds of metallic materials A and B (these are not necessarily needed to be different kinds) and a current I flows along the arrows of FIG. 1, metal atoms are ionized into cations at the electrode B to cause corrosion and electrons flow into the electrode A on the surface of which a chemical reaction occurs. A current flows in accordance with Faraday's law, and a metallic material is corroded by the amount corresponding to the quantity of electricity carried by the current.

In this invention, said metallic materials A and B both are iron. When the potential of the electrode B is lower than the electrode A from one cause or another, the reactions which occur are:

at the electrode B, $$2Fe \rightarrow 2Fe^{2+} + 4e \quad (I)$$

at the electrode A, $$O_2 + 2H_2O + 4e \rightarrow 4OH^- \quad (2)$$

and as a net reaction, $$2Fe + O_2 + 2H_2O \rightarrow 2Fe^{2+} + 4OH^- \quad (3)$$

and iron will be corroded. $Fe^{2+}$ ions and $OH^-$ ions formed by the above reaction move towards the electrodes A and B, respectively (if they do not move, the reaction stops, that is, iron is not corroded).

Thus, it will be appreciated that when corrosion occurs, the less the mobility of formed ions in an electrolytic solution, that is, the less the specific electric conductivity of electrolysis, the more the corrosion will be difficult to occur.

In actual corrosive reactions, of course, there are not definitely separated the electrodes A and B, as described above, but an infinite number of electrodes A and B, locations of which are changing with the lapse of time.

Thus, this invention provides a simple and effective corrosion inhibitive method under the consideration of specific electric conductivity.

A method of inhibiting corrosion of piping of condensate and feed water systems according to the invention is characterized by letting the water in the piping flow after also a plant has been shut down until it is restarted up and by keeping the specific electric conductivity of flowing water at 0.5 μS/cm or less.

In the system in this invention, water dissolves oxygen, but the concentration of dissolved oxygen in water, which is within such a range that corrosion inhibition may come into question due to the occurrence of corrosion by contact of carbon steels with the water dissolving oxygen, is specifically about 40 to 30,000 ppb. As described above, since the piping of the condensate and feed water systems will contact with water of 5 to 8 ppm dissolved oxygen concentration under the condition open to the air for the shutdown period of BWR plants, this invention is particularly suitable for inhibiting carbon steels of piping from corrosion.

In this invention, metallic materials to be inhibited from corrosion may be any metallic material for which corrosion inhibition may come into question because it contacts with water dissolving oxygen, particularly water of about 40 to 30,000 ppb dissolved oxygen concentration, but among others, carbon steel, low alloy steel, stainless steel, and copper and its alloys are, for example, listed. Carbon steels, which are materials for the piping of the condensate and feed water systems are effectively inhibited from corrosion by the present invention.

In this invention, it is an essential condition to keep specific electric conductivities of 0.5 μS/cm or less, and such a control may be achieved by any means. However, usually it can be, for example, achieved by reducing the specific electric conductivity by letting water flow through a desalter filled with granular cation- and anion-exchange resins. In this invention, if water is kept at specific electric conductivities of 0.5 μS/cm or less, the corrosion rates of carbon steels in contact with water are substantially decreased and effective corrosion inhibition may be achieved, and to keep the specific electric conductivity at 0.1 μS/cm or below particularly provides more remarkable corrosion inhibitive effects even if differences in flow velocity of water occur on the surfaces of carbon steels. However, where the specific electric conductivity exceeds 0.5 μS/cm, no effective corrosion inhibitive effect can be expected.

Another essential condition in this invention is to let water flow. This means that water is not caused to come in the stationary state on the surfaces of carbon steels. The degree of flowing of water is only required to be such that the specific electric conductivity is kept at a given value and the object of the invention can be achieved, and flow velocity of 0.2 to 1 cm/sec or more is usual. To let water flow, for example, it is only necessary to move water by a low pressure pump. To let water flow serves not only to keep the specific electric conductivity at 0.5 μS/cm or less, but also to inhibit the generation of local cells, which is the cause of corrosion, due to the local differences in dissolved oxygen concentration in water. Furthermore, carbon steels in contact with water have very thin films formed on their surfaces by a reaction with dissolved oxygen in water, and these oxide films inhibit the progress of corrosion by passivating action. However, since these oxide films include very fine cracks, there is a danger that corrosion progresses through these cracks, but if water is let to flow dissolved oxygen is supplied to the carbon steels through these cracks and contributes to form oxide films there, thereby inhibiting the progress of corrosion.

Temperatures at which this invention is implemented is typically 30° to 40° C., and time to apply the method of the invention may be conveniently determined in accordance with the mode of implementation.

By the way, the present invention is not limited to a method of inhibiting corrosion of piping of condensate and feed water systems in BRW plant at shutdown period thereof, but includes also a method of inhibiting corrosion of piping of secondary systems in, for example, PWR plant or thermal power plant at shutdown period thereof.

EMBODIMENT OF THE INVENTION

While embodiments will be now described, the invention should not be limited thereby.

EXPERIMENT 1

Corrosion inhibitive effects were examined with respect to different specific electric conductivities with the specific electric conductivity of water reduced by a desalting method.

Carbon steel as shown in Table 1 below was immersed into water of 8 ppm dissolved oxygen concentration and corrosion rates at a flow velocity of 0.2 cm/sec and a temperature of 30° C. were measured.

TABLE 1

| Specimen (JIS) | Chemical Component (%) | | | | |
|---|---|---|---|---|---|
| | C | Mn | P | S | Fe |
| Carbon Steel (SS41) | 0.15 | 0.69 | 0.013 | 0.92 | Balance |

Figure 1:
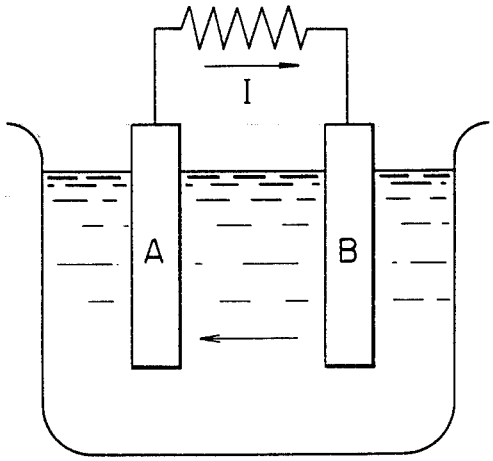
FIG. 1 is a view illustrating the principle of corrosion occurrence.
Figure 2:
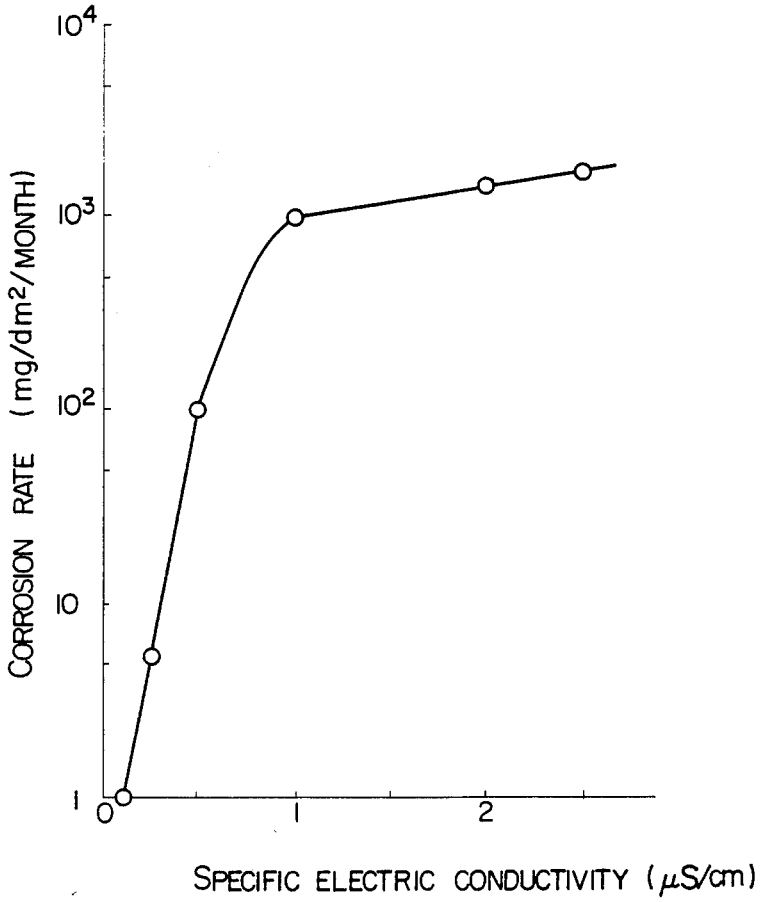
FIG. 2 is a graphical diagram showing the relation between specific electric conductivity and corrosion rate.

The measured result is shown in FIG. 2 (showing the relation between the corrosion rate of the carbon steel and the specific electric conductivity of water), in which as the specific electric conductivity decreased below 0.5 μS/cm, the corrosion rate substantially decreased.

Experiment 2

The relation between flow velocity of water and corrosion rate was examined at various specific electric conductivities.

The corrosion rate of the carbon steel (Table 1) was measured at various flow velocities with the carbon steel immersed in the water having a temperature of 30° C., a dissolved oxygen concentration of 8 ppm, and specific electric conductivities of 2.12, 1.07, 0.53 and 0.12 μS/cm.

Figure 3:
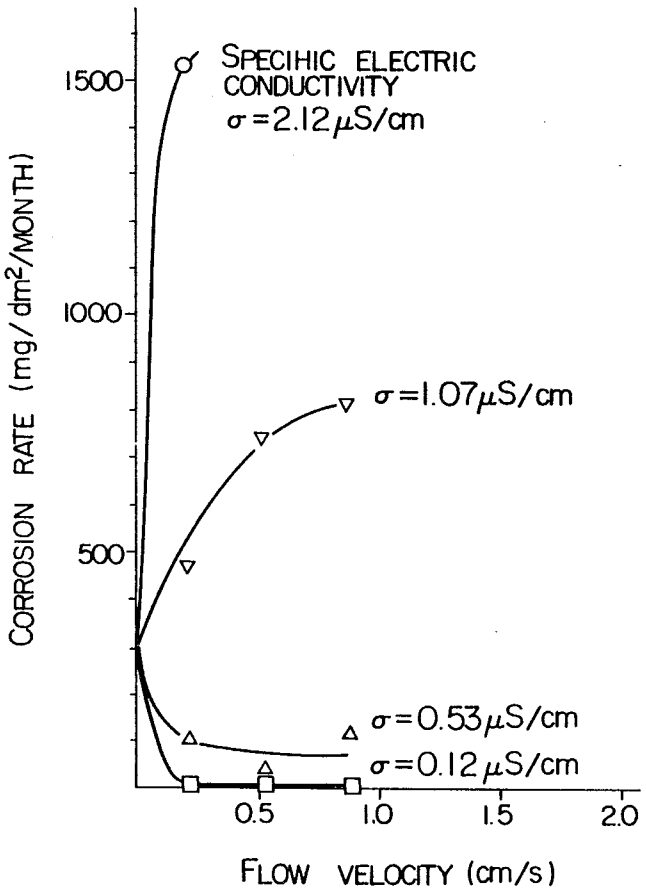
FIG. 3 is a graphical diagram showing the relation between the flow velocity of water and corrosion rate at various specific electric conductivities.

The results are shown in FIG. 3, in which it can be seen that when a specific electric conductivity of the water is above about 1 μS/cm, the higher the flow velocity of water, the higher the corrosion rate, but when the specific electric conductivity is below about 0.5 μS/cm, the higher flow velocity tends to result in the lower corrosion rate.

Experiment 3

Figure 4:
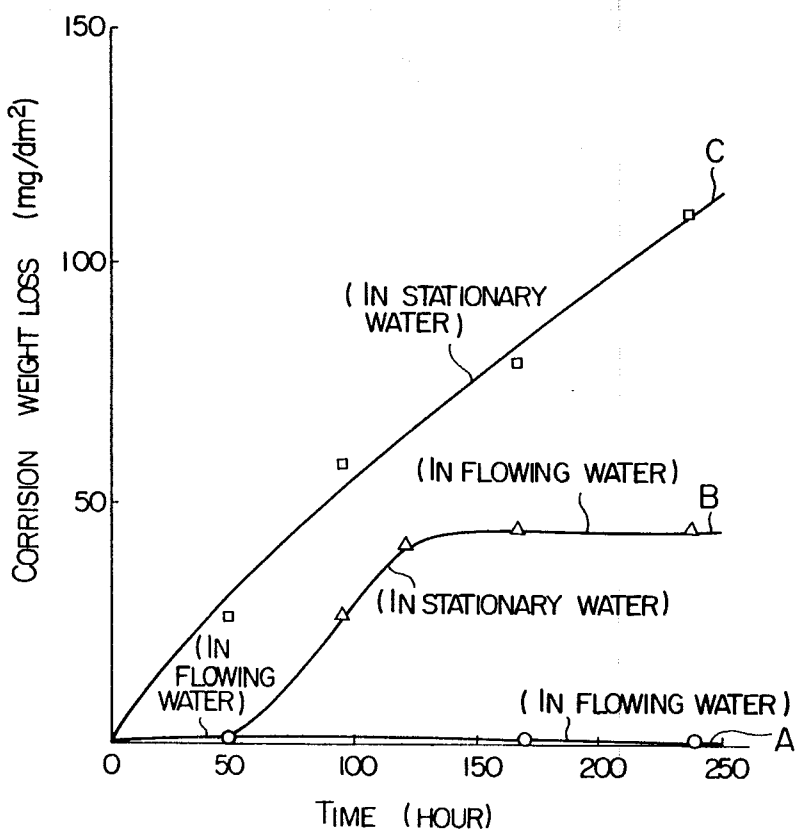
FIG. 4 is a graphical diagram showing the relation between immersion time and corrosion weight loss.

With the carbon steel (Table 1) immersed in water of 5 ppm dissolved oxygen concentration, the change with the lapse of time with respect to corrosion weight loss in the water of a specific electric conductivity of 0.1 μS/cm, a flow velocity of 1 cm/sec, and a temperature of 35° C. was measured. The results are shown in FIG. 4 (showing the relation between flowing of water and corrosion weight loss). In flowing water, corrosion weight loss is restrained to lower value almost constantly regardless the lapse of time, as shown in Curve A, while once water came in the stationary state with its flowing stopped, corrosion weight loss reached approximately 50 mg/dm$^2$ after about 70 hours and corrosion progressed, as shown in Curve B. However, when water was again let flow, corrosion weight loss remained constant as it was, and corrosion did not progress further.

For reference, when the same experiment as those described above were performed in stationary water, corrosion weight loss increased with the lapse of time, as shown in Curve C.

From above, it can be appreciated that the flowing of water is essential to the corrosion inhibition according to this invention in the view of corrosion weight loss. This is obvious also from the viewpoint of corrosion rate, which was approximately 1 mg/dm$^2$/month in flowing water, and approximately 300 mg/dm$^2$/month in stationary water.

Experiment 4

Corrosion inhibitive effects with respect to the carbon steel (Table 1) were examined at different dissolved oxygen concentrations.

Figure 5:
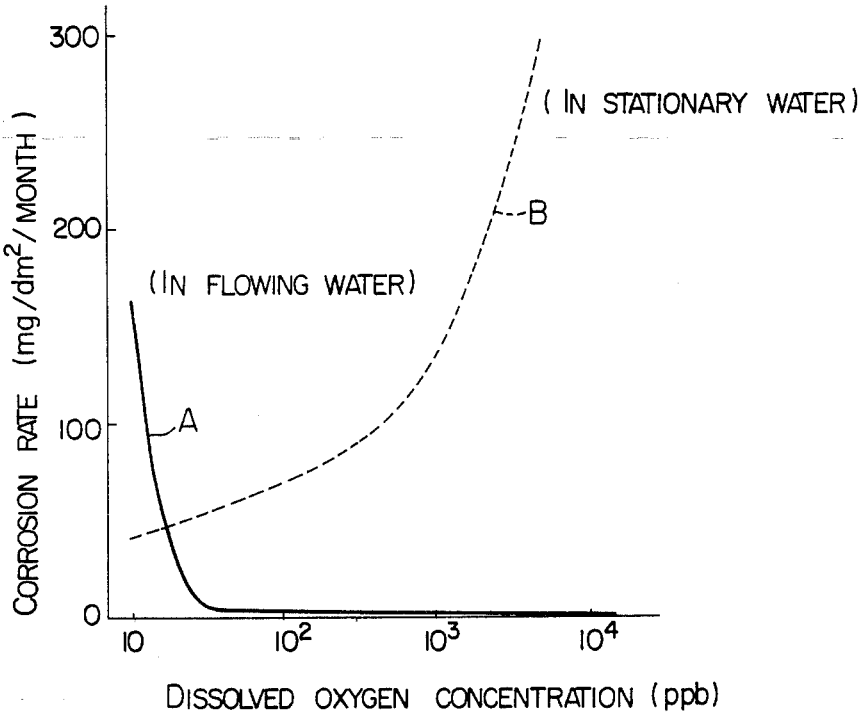
FIG. 5 is a graphical diagram showing the relation between the concentration of dissovled oxygen and corrosion rate.

With the carbon steel immersed in the highly pure water having a specific electric conductivity of 0.1 μS/cm, corrosion rate was measured at a flow velocity of 1 cm/sec and a temperature of 35° C. The results are shown in FIG. 5 (showing the relation between corrosion rate and dissolved oxygen concentration), in which the corrosion rate abruptly decreased above a dissolved oxygen concentration of 40 ppb, as shown in solid line A, and at a dissolved oxygen concentration of 5 to 8 ppm corresponding to the condition open to the air, it was approximately 1 mg/dm$^2$/month. From this, it can be seen that corrosion inhibitive effects are exhibited above a dissolved oxygen concentration of 40 ppb.

Additionally, the corrosion rate in stationary water increased with the increase of dissolved oxygen concentration, and reached approximately 300 mg/dm$^2$/month at 5 to 8 ppm, as shown in dotted line B. Comparing these results with the case in flowing water described above, it can be seen that letting water flow is essential to corrosion inhibition.

Experiment 5

Corrosion or corrosion inhibitive effect of the carbon steel (Table 1) at different specific electric conductivities was examined.

Figure 6:
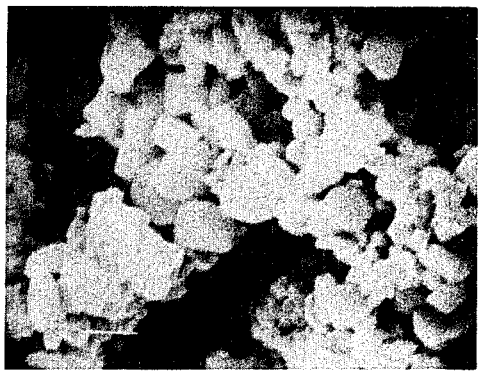
FIGS. 6 and 7 are photographs taken by a scanning electron microscope with respect to a corrosion test specimen for Example 5.

The surface of the carbon steel was observed by a scanning electron microscope after immersing in water under the following conditions: a dissolved oxygen concentration of 40 ppb, a flow velocity of 1 cm/sec, a temperature of 35° C., and an immersion time of 3960 hours with the specific electric conductivity of water kept at 0.2 to 0.5 μS/cm. A photograph of FIG. 6 shows the result observed, in which the surface of metal is covered with crystals mainly composed of magnetite of 1 μm grain size in thickness of the order of micrometer.

Figure 7:
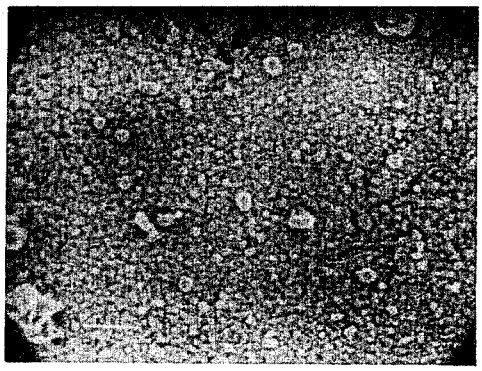

With the specific electric conductivity kept below 0.1 μS/cm, the surface of the carbon steel was observed in a similar way after immersing in water under the same conditions as above. A photograph of FIG. 7 shows the result, in which crystal grain sizes are 0.2 μm or so, and the surface of carbon steel is covered with a very dense and thin film of the order of Å.

From above results, it can be seen that when the specific electric conductivity of water kept at 0.2 to 0.5 μS/cm, and particularly below 0.1 μS/cm, good corrosion suppressive or inhibitive effects can be obtained. In addition, evaluating the corrosion inhibitive effects from the viewpoint of corrosion weight loss it is 517 mg/dm$^2$ at a specific electric conductivity of 0.2 to 0.5 μS/cm and 33.2 mg/dm$^2$ at 0.1 μS/cm. From this, it can be seen that keeping the specific electric conductivity low exhibits more remarkable corrosion inhibitive effects.

Experiment 6

Figure 8:
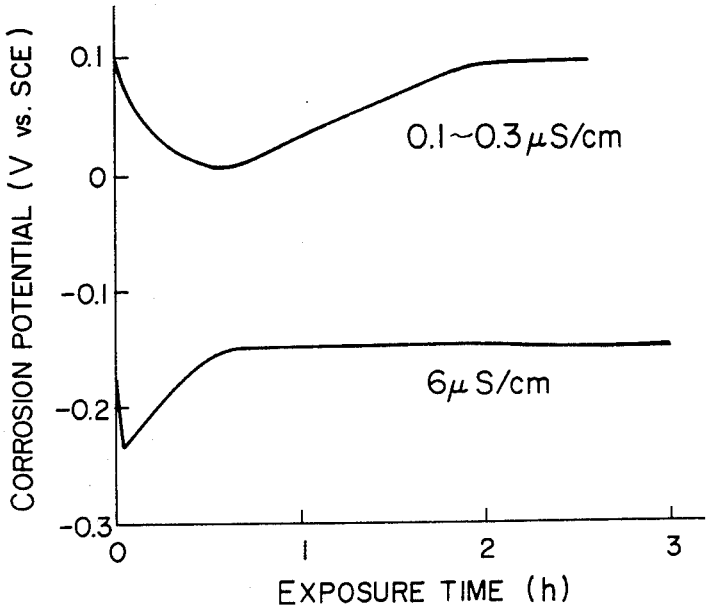
FIG. 8 is a graphical diagram showing the corrosion potentials of carbon steel immersed into the waters respectively having different electric conductivity.

FIG. 8 shows the results of the tests in which the carbon steel is immersed into the waters respectively having different specific electric conductivity, and then its corrosion potentials are measured. In these tests, the dissolved oxygen concentration of water is 8 ppm and the temperature of water is 30° C. In case where the specific electric conductivity is 6 μS/cm the corrosion potential becomes constant at −0.15 V(vs. SEC), whereas in case where it is 0.1–0.3 μs/cm the corrosion potential exhibits a noble potential of +0.10 V after about 2 hours.

Figure 9:
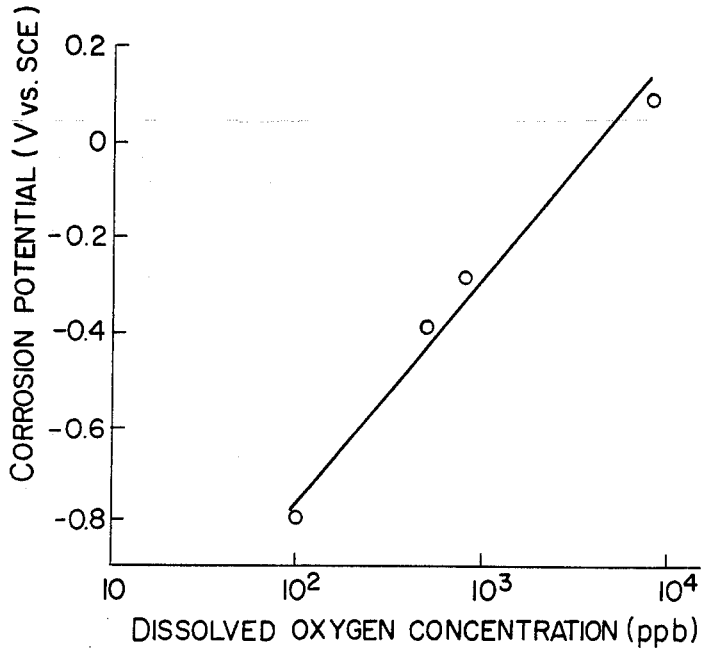
FIG. 9 is a graphical diagram showing the relation between the corrosion potential of carbon steel and the dissolved oxygen concentration in water of 0.1–0.3 μS/cm.

Further, FIG. 9 shows the results of the tests in which the corrosion potential is measured while nitrogen gas is injected into a water contained in a vessel under a condition that the specific electric conductivity is kept at 0.1–0.3 μS/cm to thereby reduce stepwise the dissolved oxygen concentration from 8 ppm. The temperature of water is 30° C. As seen in FIG. 9 the corrosion potential decreases with decrease in dissolved oxygen concentration.

From the above results it is considered that in a flowing water having a high purity of about 0.1 μS/cm and a high dissolved oxygen concentration a carbon steel is protected from being corroded owing to its passivation. The term "passivation" referred to herein means such a phenomenon that when the electric potential of a metal is changed in noble direction the stationary anode electric current in a certain environment reversely decreases thereby decreasing the anodic solution in comparison with when the electric current is less noble, and from the above mentioned two figures it is understood that when the dissolved oxygen concentration becomes high under a high purity water a noble electric current at which a coating of corrosion products formed on a surface of steel material becomes possible to be stable is obtained, and this contributes to exhibit a protection effect to thereby suppress the corrosion. From this fact it is understood that the existence of dissolved oxygen is indispensable for the passivation of metal.

Experiment 7

Figure 10:
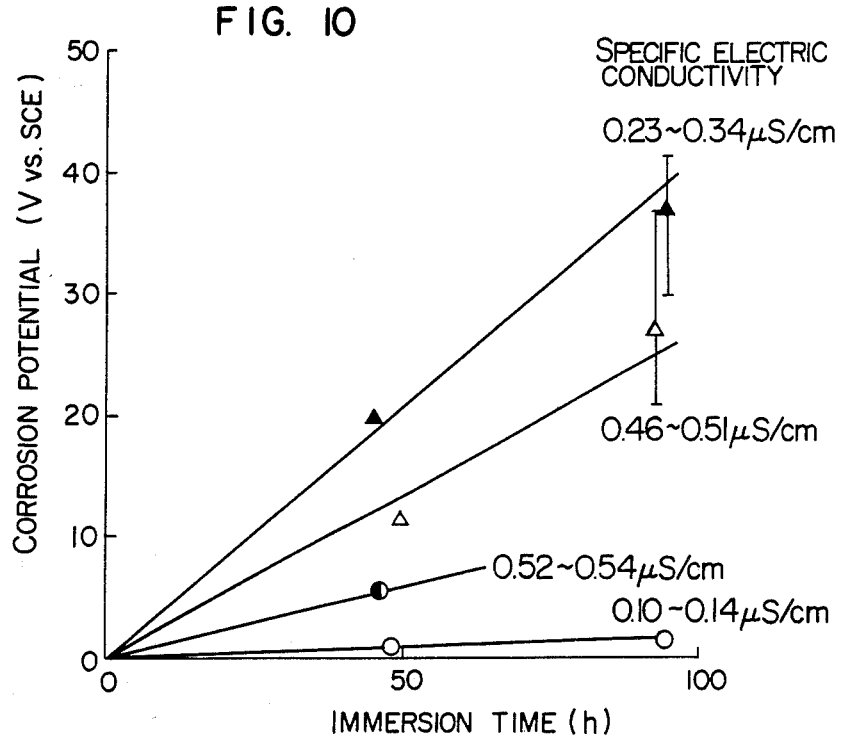
FIG. 10 is a graphical diagram showing a relatoin between the corrosion weight loss and the immersion time when the carbon steel test pieces worked to have flow velocity distribution are immersed into water having different specific electric conductivity.

FIG. 10 shows the relation between time elapse and corrosion weight loss of the carbon steel test pieces worked to have flow velocity distribution when they are immersed into water having different specific electric conductivity. In this case, the dissolved oxygen concentration is 8 ppm, the temperature is 30° C., and the bulk flow velocity of water is 0.2 cm/sec.

When there is a flow velocity distribution, even if the specific electric conductivity is less than 0.5 μS/cm there is a fear that the local corrosion occurs in the portions of low flow velocity, whereas when the specific electric conductivity is 0.1 μS/cm the corrosion is extremely suppressed even if there is a flow velocity distribution.

Example

Figure 11:
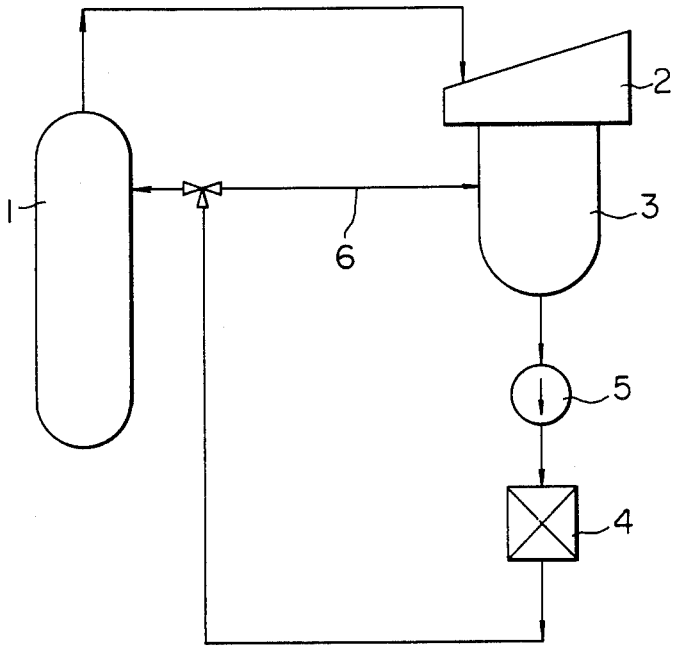
FIG. 11 is a flow diagram showing an outline of a BWR plant system.

FIG. 11 is a diagram of BWR plant, including a reactor 1, a turbine 2, a condenser 3, a condensate demineralizer 4, a low pressure condensate pump 5, and a recirculating feed water line 6.

The method of inhibiting corrosion according to the invention was implemented during the shutdown period of the BWR plant shown in FIG. 11. The piping of the condensate and feed water systems is mainly made of carbon steel, and water in contact with the piping indicated dissolved oxygen concentrations of 5 to 8 ppm under the condition open to the air. With water forced to flow through the condensate demineralizer 4 using the recirculating feed water line 6, the specific electric conductivity was reduced and kept below 0.5 μS/cm, and water was recirculated at a flow velocity of 1 cm/sec. After 750 hours, no corrosion was observed in the piping of the condensate and feed water systems.

Additionally, in this example, the principal components of the condenser 3 are cooling pipes of copper alloy and a condenser vessel of carbon steel, which have surface areas in contact with water of 40,000 $m^2$ and 8,000 $m^2$, respectively. Furthermore, there are a feed water heater and piping in the system from the low pressure condensate pump 5 through the condensate demineralizer 4 and the recirculating feed water line 6 to the condenser 3. Heating pipes of the feed water heater are made of stainless steel, a drum of the feed heater is made of low alloy steel, and the piping is made of carbon steel. Their surface areas in contact with water are approximately 15,000 $m^2$, 100 $m^2$, and 1,500 $m^2$, respectively. When this example was implemented, the concentrations of iron, copper, chromium and nickel were measured at the inlet and outlet of the condensate demineralizer 4. At both measuring points, the concentrations of these metals were always below 1 ppb.

Since, as apparent from the above description, the present invention inhibits corrosion of carbon steels in contact with water by simple means, it can be applied to the wide range of applications and is particularly suitable for corrosion inhibition of the pipeing of the condensate and feed water systems during the shutdown period of BWR plants, and therefore it has high utility value and great industrial significance.

What is claimed is:

1. A method of inhibiting corrosion of metallic piping of condensate and feed water systems in a power generating plant having a heat generator, during shutdown of said plant, characterized by continuing the water in said piping to flow, at a flow velocity of at least 0.2 cm/sec, after said plant has been shut down until it is restarted up, the water being kept flowing in the piping without flowing through the heat generator of the power generating plant, and by keeping the specific electric conductivity of the flowing water at 0.5 μS/cm or less, and wherein the dissolved oxygen concentration of said water is 40 to 30,000 ppb, whereby the dissolving of at least 40 ppb oxygen in the water, together with continuation of the water flow and keeping the specific electrical conductivity at 0.5 μS/cm or less, passivates the metal of the piping and prevents corrosion thereof.

2. A method of inhibiting corrosion of metallic piping of condensate and feed water systems in a power generating plant as claimed in claim 1, wherein the flow velocity of said water is 0.2 to 1 cm/sec.

3. A method of inhibiting corrosion of metallic piping of condensate and feed water systems in a power generating plant as claimed in claim 1, wherein the specific electric conductivity of said water is kept at 0.1 μS/cm or less.

4. A method of inhibiting corrosion of metallic piping of condensate and feed water systems in a power generating plant as claimed in claim 1, wherein the temperature of said water is kept at 30° to 40° C.

5. A method of inhibiting corrosion of metallic piping of condensate and feed water systems in a power generating plant as claimed in claim 1, wherein said power generating plant is BWR, PWR or thermal power plant.

6. A method of inhibiting corrosion of metallic piping of condensate and feed water systems in a power generating plant as claimed in claim 1, wherein the specific electric conductivity is kept at 0.5 μS/cm or less by having the water flow through a desalter containing cation-and anion-exchange resins.

7. A method of inhibiting corrosion of metallic piping of condensate and feed water systems in a power generating plant as claimed in claim 1, wherein the dissolved oxygen concentration is 5–8 ppm.

8. A method of inhibiting corrosion of metallic piping of condensate and feed water systems in a power generating plant as claimed in claim 1, wherein said piping is made of at least one material selected from the group consisting of carbon steel, low alloy steel, stainless steel, and copper and its alloys.

9. A method of inhibiting corrosion of metallic piping of condensate and feed water systems in a power generating plant as claimed in claim 8, wherein said piping is made of carbon steel.

10. A method of inhibiting corrosion of metallic piping of condensate and feed water systems in a power generating plant as claimed in claim 1, wherein the water is kept flowing from a condenser, through a condensate demineralizer and a recirculating feed water line, to the condenser, without passing through the heat generator.

11. A method of inhibiting corrosion of metallic piping of condensate and feed water systems in a BWR plant having a nuclear reactor, during shutdown of said plant, characterized by continuing the water in said piping to flow, at a flow velocity of at least 0.2 cm/sec after said plant has been shut down until it is restarted up, the water being kept flowing in the piping without flowing through the reactor of the BWR, and by keeping the specific electric conductivity of the flowing water at 0.5 μS/cm or less, and wherein the dissolved oxygen concentration of said flowing water is kept at 40 to 30,000 ppb, whereby the dissolving of at least 40 ppb oxygen in the water, together with continuation of the water flow and keeping the specific electrical conductivity at 0.5 μS/cm or less, passivates the metal of the piping and prevents corrosion thereof.

12. A method of inhibiting corrosion of metallic piping of condensate and feed water systems in a BWR as claimed in claim 11, wherein the dissolved oxygen concentration is 5 to 8 ppm, the specific electric conductivity is 0.1 to 0.2 μS/cm, and the flow velocity is 0.2 to 1 cm/sec.

13. A method of inhibiting corrosion of metallic piping of condensate and feed water systems in a BWR plant as claimed in claim 11, wherein keeping the value of the specific electric conductivity of said water and the flowing state is performed by the use of a recirculating feed water line provided in the condensate and feed water systems.

14. A method of inhibiting corrosion of metallic piping of condensate and feed water systems in a BWR plant as claimed in claim 11, wherein the dissolved oxygen concentration is 5–8 ppm.

15. A method of inhibiting corrosion of metallic piping of condensate and feed water systems in a BWR plant as claimed in claim 11, wherein the specific electric conductivity of said water is kept at 0.1 μS/cm or less.

16. A method of inhibiting corrosion of metallic piping of condensate and feed water systems in a BWR plant as claimed in claim 11, wherein the temperature of said water is kept at 30°–40° C.

17. A method of inhibiting corrosion of metallic piping of condensate and feed water systems in a BWR plant as claimed in claim 11, wherein said piping is made of at least one material selected from the group consisting of carbon steel, low alloy steel, stainless steel, and copper and its alloys.

18. A method of inhibiting corrosion of metallic piping of condensate and feed water systems in a BWR plant as claimed in claim 17, wherein said piping is made of carbon steel.

19. A method of inhibiting corrosion of metallic piping of condensate and feed water systems in a BWR plant as claimed in claim 11, wherein the water is kept flowing from a condenser, through a condensate demineralizer and a recirculating feed water line, to the condenser, without passing through the reactor.

* * * * *